US008689987B2

(12) United States Patent
Lewis

(10) Patent No.: US 8,689,987 B2
(45) Date of Patent: Apr. 8, 2014

(54) CONTAINER ADAPTER

(76) Inventor: Linda A. Lewis, Galesburg, IL (US)

( * ) Notice: Subject to any disclaimer, the term of this patent is extended or adjusted under 35 U.S.C. 154(b) by 130 days.

(21) Appl. No.: 13/134,086

(22) Filed: May 27, 2011

(65) Prior Publication Data

US 2012/0085726 A1 Apr. 12, 2012

Related U.S. Application Data

(63) Continuation-in-part of application No. 11/809,152, filed on May 31, 2007, now abandoned.

(51) Int. Cl.
*B65D 47/10* (2006.01)

(52) U.S. Cl.
USPC ..... 215/211; 215/11.1; 215/11.6; 215/228; 215/276; 215/229; 141/322; 141/337; 141/340; 141/342; 141/98; D15/152; D7/700

(58) Field of Classification Search
USPC ..... 215/11.1, 11.6, 228, 276, 386, 229, 215/211; 141/322, 337, 340, 342, 98; D15/152; D7/700
See application file for complete search history.

(56) References Cited

U.S. PATENT DOCUMENTS

| | | | | | |
|---|---|---|---|---|---|
| 518,530 | A | | 4/1894 | McAlpin | |
| 589,659 | A | | 9/1897 | Krack | |
| 790,080 | A | | 5/1905 | Seavy | |
| 1,134,837 | A | * | 4/1915 | Fox | 210/482 |
| 2,884,151 | A | * | 4/1959 | Biederman | 215/329 |
| 3,071,272 | A | | 1/1963 | Byron | |
| 3,341,044 | A | | 9/1967 | Valk | |
| 4,112,984 | A | * | 9/1978 | Guglia et al. | 141/98 |
| 4,149,575 | A | | 4/1979 | Fisher | |
| D266,400 | S | * | 10/1982 | Shatz | D15/152 |
| 4,559,984 | A | * | 12/1985 | Wycech | 141/340 |
| 4,703,863 | A | | 11/1987 | Kohus | |
| 4,811,870 | A | * | 3/1989 | Bianco | 222/461 |
| D309,558 | S | * | 7/1990 | Ayyoubi et al. | D23/200 |
| 5,024,341 | A | | 6/1991 | Dekerle | |
| 5,101,870 | A | | 4/1992 | Farris | |
| 5,114,011 | A | | 5/1992 | Robbins | |
| 5,292,035 | A | | 3/1994 | Millar | |
| 5,549,227 | A | * | 8/1996 | Klotz | 222/461 |
| 5,588,548 | A | | 12/1996 | Brankley | |

(Continued)

FOREIGN PATENT DOCUMENTS

| | | |
|---|---|---|
| FR | 2603187 | 3/1988 |
| JP | 08-276913 | 10/1996 |

*Primary Examiner* — Anthony Stashick
*Assistant Examiner* — Cynthia Collado
(74) *Attorney, Agent, or Firm* — Barnes & Thornburg LLP; Grant H. Peters

(57) ABSTRACT

A container adapter for use in feeding human infants and animal infants is shown. The container adapter has an internal threaded portion that can comprise a set of thread segments sized and configured to match the external threads of a commercially available soda or bottled liquid container, and can have an external threaded portion sized to match the internal threads of a standard nipple ring for an infant feeding bottle. The container adapter includes a funnel that provides a user with assistance in inserting infant feeding ingredients into the liquid container by placing the container adapter on the liquid container to use the funnel of the container adapter to place infant feeding ingredients into the liquid container. The container adapter is then inverted and installed onto the liquid container. A nipple within a collar is attached to the container adapter thus converting the liquid container to an infant feeding bottle.

19 Claims, 3 Drawing Sheets

(56) References Cited

U.S. PATENT DOCUMENTS

| | | | | |
|---|---|---|---|---|
| 5,762,120 | A | 6/1998 | Smith | |
| 5,791,503 | A | 8/1998 | Lyons | |
| 5,921,296 | A | 7/1999 | Porter et al. | |
| 5,950,689 | A | 9/1999 | Varlet | |
| 6,089,389 | A * | 7/2000 | Sharon et al. | 215/11.1 |
| 6,116,439 | A | 9/2000 | Yaniv | |
| 6,209,737 | B1 | 4/2001 | Bliss | |
| 6,223,792 | B1 | 5/2001 | Slagle | |
| 6,354,449 | B1 * | 3/2002 | Smith | 215/11.1 |
| 6,397,907 | B1 | 6/2002 | Heintz | |
| 6,415,937 | B1 | 7/2002 | DeJong et al. | |
| 6,425,424 | B1 | 7/2002 | Ellis Calvo et al. | |
| D486,225 | S | 2/2004 | Gay | |
| 6,851,565 | B2 * | 2/2005 | Stephan | 215/389 |
| 6,935,389 | B1 * | 8/2005 | Rinaldi | 141/337 |
| 7,690,521 | B1 * | 4/2010 | Herrera | 215/11.1 |
| 8,109,399 | B1 * | 2/2012 | Sheffield et al. | 215/386 |
| 2002/0162816 | A1 | 11/2002 | Walsh | |
| 2003/0029829 | A1 * | 2/2003 | Stephan | 215/387 |
| 2005/0194342 | A1 | 9/2005 | Nhan et al. | |
| 2006/0151420 | A1 | 7/2006 | Espenschied | |
| 2007/0079898 | A1 | 4/2007 | Grover et al. | |
| 2009/0107582 | A1 | 4/2009 | Sayage | |

* cited by examiner

CONTAINER ADAPTER

CROSS REFERENCE TO RELATED APPLICATIONS

This application is a continuation-in-part application of U.S. nonprovisional patent application Ser. No. 11/809,152 filed May 31, 2007 which is incorporated herein by reference in its entirety as if fully stated herein, and for all applicable purposes including all applicable priority dates.

STATEMENT REGARDING FEDERALLY SPONSORED RESEARCH

Not Applicable.

BACKGROUND OF THE INVENTION

This invention relates to a container adapter for adapting commercial containers, and more specifically to an adapter that can be assembled onto containers such as, for example, commercially available water containers and commercially available carbonated beverage containers, to allow the container to be adapted for use as part of a liquid delivery system.

The care of a infant, whether human or animal, is a demanding task and includes taking care of every need a infant has at the time the need is required of the infant. One of the most important tasks in taking care of an infant is the feeding. This often includes the feeding of special formulas that meets the exact needs of the individual infant. In some cases, this means using commercially available canned formulas, while in other instances, this means preparing the formula using a combination of powered formula mixed with sterile water.

When the preparation of the formula is done while at the home of the infant, this process is usually straightforward and, although time consuming, can be accomplished without much concern about the proper preparation of the formula. However, when traveling, the preparation of infant feeding formula can be very problematic. For example, the water used within the formula must be generally sterile. This usually means that normal tap water cannot be used without heating the water to a level that kills most of the contaminating bacteria that may be in the tap water. Once the formula powder is added to the water, refrigeration is also necessary and the formula is only good for a limited time.

SUMMARY OF THE INVENTION

This section provides a general summary of the disclosure, and is not a comprehensive disclosure of its full scope or all of its features.

In accordance with the various embodiments of the present invention, this invention relates to a unique container adapter is disclosed that allows commercially available liquid containers to be adapted for use with liquid delivery devices. In a preferred embodiment of the present invention, the container adapter can be used to assist in the feeding of human infants. Yet other embodiments of the present invention may also be used by veterinarians or those caring for animals to assist in the feeding of those animals.

Various preferred embodiments of the present invention include an adapter that turns bottled water into a baby bottle. Preferred embodiments include a dual-positioned, funnel shaped adapter with internal and external threads. When attached to a bottle funnel side up, additive products can easily be added to the small opening of bottled water. The adapter is then unscrewed, flipped, and screwed back on far enough that the bottle neck of the container protrudes through the opening. The nipple is then attached, thus forming a seal between the bottle neck and nipple. These features—the funnel, the method of engagement and the seal allows this product to have no direct competition in the market place.

One innovative feature of this adapter is it fits all three water bottles types. The differences in the three bottle types include:

Bottle 1: Bottle made dually for carbonated products and water, i.e. Pepsi/Aquafina having a thread OD of 1.075.

Bottle 2: Standard bottle used by the companies that only deal with water.

Bottle 3: The bottle designed as part of the "green initiative" that has a shortened bottle neck (0.050" less than bottle 2) and an OD dimension of 1.025".

There are water bottle adapters on the market today, but they only accommodate one thread pitch and one thread size which means a separate adapter must be used for each bottle type. The end user must be careful to use the correct adapter with the correct bottle type to avoid leaking. Embodiments of the present invention eliminate this problem.

Three features of some preferred embodiments allow this single adapter to fit all bottle types—the first being the thread size and placement. Two internal thread segments, instead of complete threads, are used to catch the threads of the receiving bottle, eliminating the pitch difference. These thread segments are strategically placed to partially catch the receiving bottle threads but engage enough for a secure fit. Using thread segments keeps cross-threading from occurring.

The second condition is the deep, internal penetration of these two thread segments. These deepened segments extend internally far enough to reach the reduced bottle neck of Bottle 3, however, these deep threads penetrate inward too far and will not fit the largest Bottle 1. This is where the third condition, the expansion slits, come into play.

The soft material of some preferred embodiments of the adapter has two expansion slits in the threaded section, 180 degrees apart, that expands as the adapter is pushed, then twisted onto the larger Bottle neck 1. The extreme difference between the bottles is 0.050". The nipple/collar assembly can still be screwed onto the external threads of the adapter and actually compresses the adapter onto the bottle neck.

Some preferred embodiments of the adapter also have two additional functions that will not be found in any other product that might be used to convert a bottled water container into a baby bottle. This conical shaped adapter of the preferred embodiments can act as a funnel. When screwed onto the water bottle with the wide mouth pointing up, formula, vitamins or any other water enhancement can be added.

The second feature is the seal. The water bottle neck protrudes through the opening as the adapter is tightened so when the nipple/collar is screwed on, the seal is made.

In a first preferred embodiment there are also other embodiments that include various thread combinations that allow the first preferred embodiment to be used in various ways and with various threads. For example, a first alternative embodiment of the invention has full internal threads for attaching the container adapter A to the external threads of a standard commercial water container. A second alternative embodiment of the invention has full internal threads for attaching the container adapter A to the external threads of a standard carbonated beverage container. A third alternative embodiment of the invention has full internal threads for attaching the container adapter A to the external threads of a standard commercial water container and also includes an external thread to which a standard human baby bottle nipple and ring is attached. A fourth alternative embodiment of the invention has full internal threads for attaching the container adapter A to the external threads of a standard carbonated beverage container and also includes an external thread to which a standard human baby bottle nipple and ring is attached.

In a fifth alternative set of embodiment, each of the previous four embodiments do not have full internal threads, but instead have partial thread segments that are sized, shaped, and located such as to allow partial thread segments to functionally engage the external threads of either a standard commercial bottled water container or a standard carbonated beverage container. This is to say, all the container adapter embodiments have a funnel and an internal thread engagement portion, but that the internal threads can be varied to match the various liquid containers onto which the container adapter will be disposed and external threads can be added when attachment to other devices is desired.

Further areas of applicability will become apparent from the description provided herein. The description and specific examples in this summary are intended for purposes of illustration only and are not intended to limit the scope or the claims of the present disclosure.

DESCRIPTION OF THE DRAWINGS

In the accompanying drawings which form part of the specification.

Corresponding reference numerals indicate corresponding steps or parts throughout the several figures of the drawings.

While one embodiment of the present invention is illustrated in the above referenced drawings and in the following description, it is understood that the embodiment shown is merely one example of a single preferred embodiment offered for the purpose of illustration only and that various changes in construction may be resorted to in the course of manufacture in order that the present invention may be utilized to the best advantage according to circumstances which may arise, without in any way departing from the spirit and intention of the present invention, which is to be limited only in accordance with the claims contained herein.

DETAILED DESCRIPTION OF AT LEAST ONE EMBODIMENT OF THE INVENTION

In the following description, numerous specific details are set forth such as examples of some preferred embodiments, specific components, devices, methods, in order to provide a thorough understanding of embodiments of the present disclosure. It will be apparent to a person of ordinary skill in the art that these specific details need not be employed, and should not be construed to limit the scope of the disclosure. In the development of any actual implementation, numerous implementation-specific decisions must be made to achieve the developer's specific goals, such as compliance with system-related and business-related constraints. Such a development effort might be complex and time consuming, but is nevertheless a routine undertaking of design, fabrication, and manufacture for those of ordinary skill.

Figure 1:
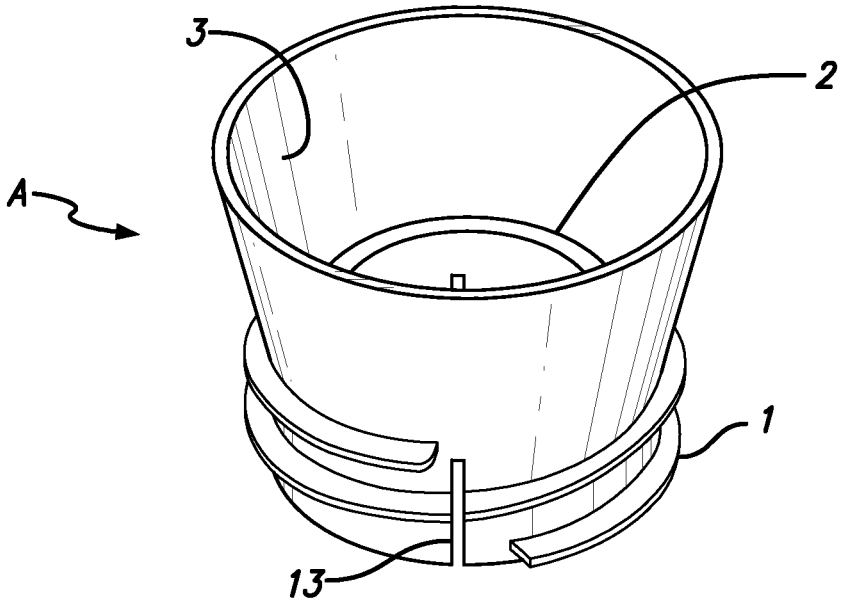
FIG. 1 shows a perspective view of one embodiment of the present invention.
Figure 2:
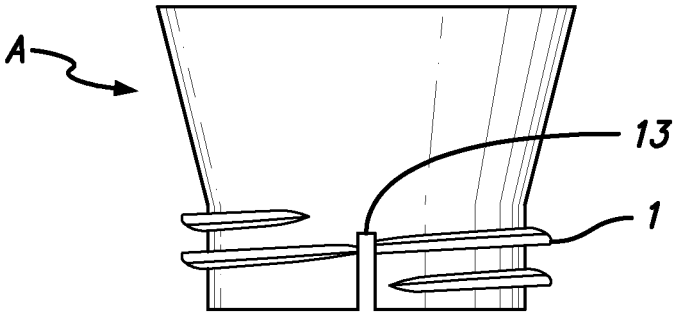
FIG. 2 shows an elevation section view of one embodiment of the present invention.

A preferred embodiment of the present invention is illustrated in FIG. 1. In this embodiment, a container adapter A is shown. The present embodiment of the container adapter A comprises an external threaded portion 1 conforming to the threads of a standard infant bottle nipple ring adapter's internal threads, a set of internal thread segments 2 that are capable of engaging the three different bottle types with varying bottle neck thicknesses and thread pitches of liquid container 6 (FIG. 6), expansion slits 13 to enable the connection with all bottle types and a funnel 3 (FIG. 1). The external threaded portion 1 is co-axial with the set of internal thread segments 2 and the funnel 3. In alternative embodiments, the container adapter A will not be intended for use with a standard infant bottle nipple ring and thus will not have the external threaded portion 1, but will still include the set of internal thread segments 2.

Figure 3:
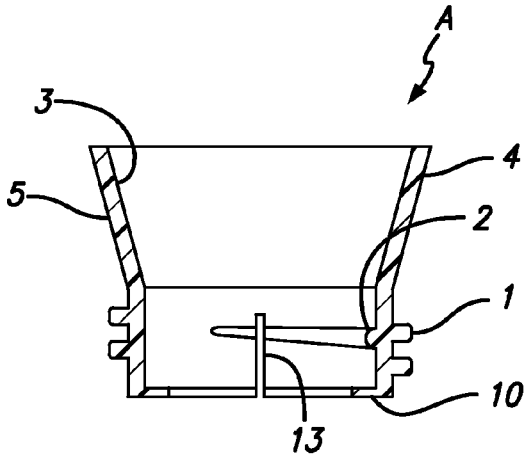
FIG. 3 shows a vertical section view of one embodiment of the present invention.
Figure 4:
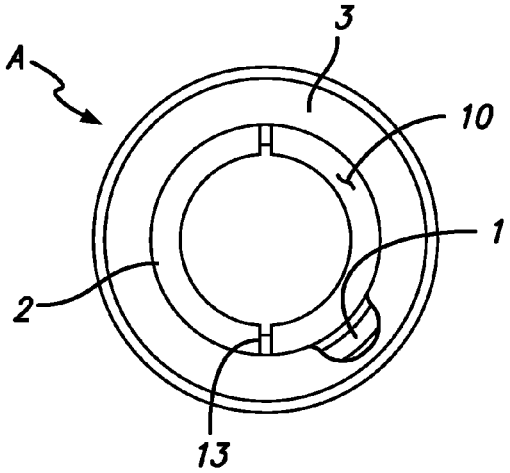
FIG. 4 shows a bottom view of one embodiment of the present invention.

Two semicircular or arcuate gripping elements 10 (FIGS. 3-5) are located at an end of the external threaded portion 1. The semicircular gripping elements 10 may be integral with the material that forms the container adapter A, however, the thickness of the semicircular gripping elements should be thin enough to allow the semicircular gripping elements to maintain some flexibility. This is because the primary purpose of the semicircular gripping elements 10 is to allow the container adapter A to be temporarily disposed over the mouth of the liquid container 6 (FIG. 6) while the baby formula ingredient is being placed into the liquid container. In a preferred embodiment, the thickness of the semicircular gripping elements is between about 0.08 inch and about 0.011 inch.

Certain embodiments of the container adapter A also comprise a set of expansion slits 13 (FIG. 1 through FIG. 5) that are necessary to allow container adapter A to fit all the industry water bottles. These expansion slits are located in the threaded portion of the container adapter. More specifically, the set of expansion slits 13 for the present embodiments includes two expansion slits that are position 180 degrees apart within the diameter of the threaded portion. The two expansion slits 13 are between about 0.02 inch and about 0.03 inch in width and are between about 0.25 inch and about 0.38 inch in height. The expansion slit depth, width and position could change depending on the receiving container 6.

The funnel 3 can be up to 90% of the overall length of the container adapter A. In a preferred embodiment, the external threaded portion 1 is between about 0.50 inches and about 0.88 inches in length. In other embodiments, the lengths of the external threaded portion 1 can be adjusted as needed for any specific application in which the container adapter is used. In one embodiment, the funnel 3 has a gradual increase in diameter between the proximate end of the funnel nearest the external threaded portion 1 and the distal end of the funnel furthest from the external threaded portion. In the present embodiment, the funnel 3 is indeed funnel-shaped with the smallest end of the funnel being the proximate end of the funnel that is disposed nearest the external threaded portion 1 and the walls of the funnel are not a right angles to the axis of the container adapter A. It is also understood that in the present embodiment there are no external threads on the outside surface of the funnel portion. It will be appreciated by those skilled in the that art that the shape of the funnel 3 can be adjusted as needed to fit the specific end use of the container adapter and still remain within the scope of the present invention. The funnel portion has no internal or external threads.

In a preferred embodiment, the container adapter A is made from a plastic that can be either heavy, medium, or lightweight. It will be appreciated, however, that the material used to make the container adapter A can be of any material as long as the material selected provides the necessary rigidity and durability to allow the container adapter to function as an intermediate device disposed between a liquid container 6 such as, for example, a commercial bottled water container or a carbonated beverage bottle, and a baby nipple and securing ring.

In operation, the container adapter A of one embodiment of the present invention (FIG. 6) can be used to help mix infant formula with the contents 7 of the liquid container 6. The container adapter A can also be used to convert the liquid container 6 to an infant feeding bottle by converting the standard external threads of the container adapter A to match the standard internal threads of an infant feeding bottle cap 8.

To use the container adapter A of a preferred embodiment of the present embodiment, the cap from the liquid container 6 (FIG. 6) is removed from the bottled water container. A sufficient amount of liquid is then removed from the liquid container 6. It is understood that the amount of liquid removed from the liquid container 6 can be adjusted as needed to fit the specific recipe for the ingredient being added and the type of infant, whether human or animal, being fed.

Figure 6:
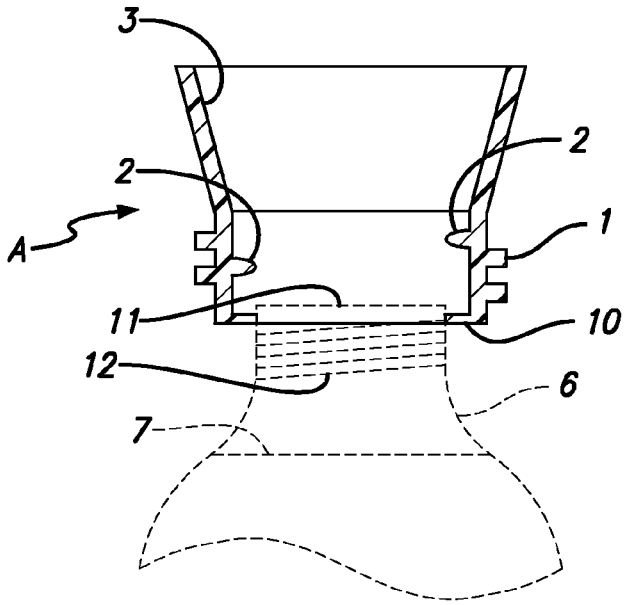
FIG. 6 shows one embodiment of the present invention as used in one exemplary application when ingredients are being added to the container.

To pour the ingredient into the liquid container 6, the container adapter A is temporarily connected to the liquid container 6 as shown in FIG. 6. The connection is made by first positioning the container adapter A over the top 11 of the liquid container 6 such that the funnel 3 points away from the top of the liquid container and that the axis of the container adapter generally aligns with the liquid container. The container adapter A is then lowered onto the top 11 just enough to allow the semicircular gripping elements 10 to slide over the tip of the liquid container 6 and stop before the semicircular gripping elements comes into contact with the external threads 12 of the liquid container. Because the semicircular gripping elements 10 is generally flexible, the inside diameter of the semicircular gripping elements tends to be pushed aside as the top 11 of the liquid container 6 enters inside diameter of the semicircular gripping elements. It is understood that the inside diameter of the semicircular gripping elements 10 is slightly smaller than the outside diameter of the threaded portion 12 of the liquid container 6 and that this causes an interference between the semicircular gripping elements and the liquid container 6. While the semicircular gripping elements 10 is gripping the liquid container 6, the ingredient is fed through the container adapter A by pouring the ingredient into the funnel 3 and allowing gravity to cause the ingredient to slide down the sides of the funnel and into the liquid container 6. When the desired amount of ingredient, whether in powdered form, liquid form, or any other form, has been placed into the liquid container 6, the container adapter A is removed from the top of the liquid container by disengaging the semicircular gripping elements 10 from the liquid container.

Figure 7:
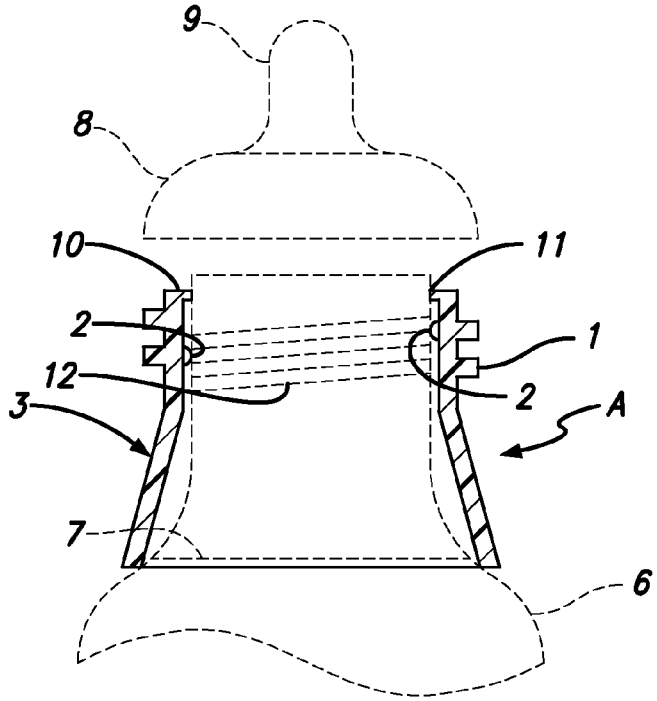
FIG. 7 shows one embodiment of the present invention as used in one exemplary application when the container adapter and the container are ready for use to feed an infant.

After the ingredient has been placed within the liquid container 6, the container adapter A in FIG. 7 is removed from the liquid container 6 while the liquid container 6 is held in a position that will prevent the contents of the liquid container from spilling out of the liquid container. The position of the container adapter A is then rotated about 180 degrees such that the funnel 3 is now pointed away from the opening of the liquid container 6. The container adapter A is then installed onto the liquid container 6 by screwing the container adapter to engage the set of internal thread segments 2 onto the external threads 12 of the liquid container. Container adapter A is tightened down far enough onto the liquid container 6 so that the liquid container 6 bottle neck protrudes through the circumferential opening of container adapter A.

When the container adapter A and the liquid container 6 (FIG. 7) are substantially connected together, a standard nipple ring 8 having a nipple 9 installed therein is attached to the container adapter A by screwing the internal threads of the standard nipple ring 8 onto the external threaded portion 1 of the container adapter A. The nipple 9 and bottle neck 11 form a seal as the nipple ring 8 is tightened onto the liquid container 6. The liquid container 6 can then be shaken to mix ingredients and will not leak.

Figure 5:
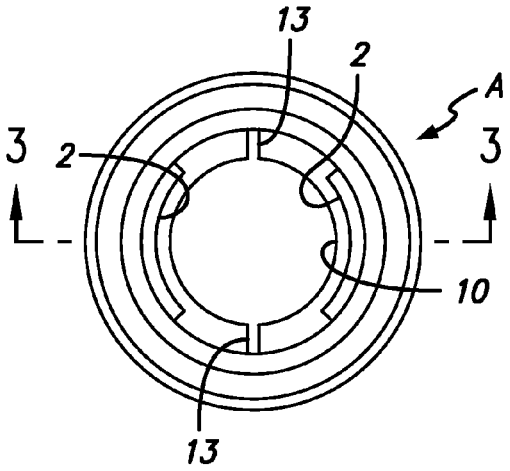
FIG. 5 shows a top view of one embodiment of the present invention.

It is noted that within the plastic bottle industry there are three primary types of bottles with three different external thread patterns and three different bottle neck heights. The first is used in an industry that makes both soda and water. The threads on this bottle must be heavy enough to hold the pressure of carbonation. The second is used in an industry that only makes water, therefore, the threads do not have to be as heavy. The third bottle was designed as part of the "green initiative" and uses less plastic by having a shortened and thinned out bottle neck and minimal threads. To accommodate the threads used on all three water bottle types, the container adapter A of the present invention does not utilize full and continuous threads for the internal threaded portion as does the container adapter A. Instead, as shown in FIG. 5, the set of internal threads 2 of the present embodiment comprises two thread segments 2 that have been specifically located and configured to be capable of engaging with each of the three primary types of threads. The technical specifications for the three primary types of threads used on water bottles are well-known in the industry and those of skill in the art will be readily able to determine the size and configuration of the set of internal thread segments 2 needed to use the container adapter A in alternative and specific applications that may include alternative quantities of thread segments.

In order for the thread segments 2 to engage all the bottle types, the internal threads of container adapter A have to penetrate inward far enough to connect with the external threads of the thinnest bottle which then causes container adapter A to no longer fit the heaviest bottle type. To overcome this issue, two expansion slits, 180 degrees apart, cutting through the internal and external threads of container adapter A expand as the container adapter A is applied onto the heaviest bottle.

It is also understood that in the current embodiment, the set of internal thread segments 2 are made from, and are integral with, the same material as the container adapter A. However, it will be understood by those skilled in the art that the set of internal thread segments 2 may also not be integral with the material of the container adapter A. For example, in other embodiments of the present invention, the set of internal thread segments 2 may be formed in conjunction with a separate inner ring that might be insertable into the cylindrical opening of the container adapter A. In fact, the scope of the present embodiment of this invention is intended to cover any and all such integral or non-integral arrangements as long as the general location and dimensions of the present invention are included.

It is also understood that while the embodiments herein include a set of internal thread segments 2 for soda and bottled water plastic bottles within the United States, it will be recognized by those skilled in the art that the location and dimensions can easily be adjusted to fit the varying bottle necks from any other bottle from any other country using containers having external threads upon which the container adapter of the present invention may be installed. That is to say, the set of internal thread segments of any of the embodiments disclosed herein can be readily adjusted by reconfiguration and relocation of the thread segments to match any external threaded portion of any container.

It will be appreciated by one of ordinary skill in the art that liquid containers may have yet other different types of external threads and different water bottle neck dimensions. It is also understood that infant bottle nipple rings may also vary in diameter having differing types of internal threads depending on whether a human infant is being fed or another animal such as, for example, a horse or a cow is being fed. As such, it is understood that other embodiments of the present can be easily adapted to conform to the different threads used on the liquid container or the infant bottle nipple rings and still remain within the intended scope of the present invention.

In the preceding description, numerous specific details are set forth such as examples of specific components, devices, methods, in order to provide a thorough understanding of embodiments of the present disclosure. It will be apparent to a person of ordinary skill in the art that these specific details need not be employed, and should not be construed to limit the scope of the disclosure. In the development of any actual implementation, numerous implementation-specific decisions must be made to achieve the developer's specific goals, such as compliance with system-related and business-related constraints. Such a development effort might be complex and time consuming, but is nevertheless a routine undertaking of design, fabrication and manufacture for those of ordinary skill. The scope of the invention should be determined by any appended claims and their legal equivalents, rather than by the examples given.

Additionally, it will be seen in the above disclosure that several of the intended purposes of the invention are achieved, and other advantageous and useful results are attained. As various changes could be made in the above constructions without departing from the scope of the invention, it is intended that all matter contained in the above descriptions or shown in the accompanying drawings shall be interpreted as illustrative and not in a limiting sense.

Terms such as "proximate," "distal," "upper," "lower," "inner," "outer," "inwardly," "outwardly," "exterior," "interior," and the like when used herein refer to positions of the respective elements as they are shown in the accompanying drawings, and the disclosure is not necessarily limited to such positions. Terms such as "first," "second," and other numerical terms when used herein do not imply a sequence or order unless clearly indicated by the context.

When introducing elements or features and the exemplary embodiments, the articles "a," "an," "the" and "said" are intended to mean that there are one or more of such elements or features. The terms "comprising," "including," and "having" are intended to be inclusive and mean that there may be additional elements or features other than those specifically noted. It is further to be understood that the method steps, processes, and operations described herein are not to be construed as necessarily requiring their performance in the particular order discussed or illustrated, unless specifically identified as an order of performance. It is also to be understood that additional or alternative steps may be employed.

It will also be understood that when an element is referred to as being "operatively connected," "connected," "coupled," "engaged," or "engageable" to and/or with another element, it can be directly connected, coupled, engaged, engageable to and/or with the other element or intervening elements may be present. In contrast, when an element is referred to as being "directly connected," "directly coupled," "directly engaged," or "directly engageable" to another element, there are no intervening elements present. Other words used to describe the relationship between elements should be interpreted in a like fashion (e.g., "between" versus "directly between," "adjacent" versus "directly adjacent," etc.).

What is claimed is:

1. A container adapter compatible with and for removable attachment to more than one standardized form of container having a neck with at least one external container thread, the container adapter comprising:

a funnel portion including a funnel wall, the funnel wall defining a first edge;

a cylindrical portion integral with and extending from the first edge, the cylindrical portion having a wall with an inside surface and an outside surface with the wall defining a cavity extending through and communicating with the funnel portion;

more than one internal thread segment provided on the inside surface of the cylindrical portion each segment spaced circumferentially from each other segment, the more than one internal thread segment being configured for engagement with the at least one external container thread on the neck of one of more than one standardized forms of container; and at least one expansion slit of the container adapter, each slit extending from an inside surface to an outside surface of the cylindrical wall for facilitating expansion of the wall when applying the container adapter to the neck of standardized containers of a variety of dimensions.

2. The container adapter of claim 1, wherein the cylindrical portion includes a funnel edge coupled to the first edge of the funnel portion and a container edge spaced apart from the funnel edge, at least one gripping portion positioned proximate to and extending generally from the container edge end of the cylindrical portion, the at least one gripping portion providing engagement between the cylindrical portion and the neck of the container when the cylindrical portion is coupled to the container neck.

3. The container adapter of claim 2, further comprising two generally arcuate gripping portions positioned in the cylindrical portion generally in opposition to each other.

4. The container adapter of claim 2, wherein the at least one gripping portion is generally flexible and frictionally engages the neck of the container.

5. The container adapter of claim 1, wherein the at least one internal thread segment is disposed around an inside surface of the cylindrical portion and extending into the cavity defined by the cylindrical portion, the at least one internal thread segment is adapted to engage with the external container threads of the container and the at least one internal thread segment being engagable with multiple containers having different external container thread configurations or dimensions.

6. The container adapter of claim 5, wherein the cylindrical portion includes an external threaded portion, the external threaded portion being configured for receiving a cooperatively threaded nipple-and-ring assembly.

7. The container adapter of claim 5, wherein the internal thread segments are threadably couplable to the external container threads of the container when the funnel portion is positioned between the cylindrical portion and the container, and the internal thread segments are not threadably coupled to the external container threads of the container when the cylindrical portion is positioned between the funnel portion and the container.

8. The container adapter of claim 7, wherein the internal thread segments are threadably couplable to the external container threads of the container when the funnel portion is positioned between the cylindrical portion and the container and a mouth of the container neck extends upwardly through the cylindrical opening.

9. The container adapter of claim 8, wherein the cylindrical portion includes an external threaded portion, the external threaded portion being configured for receiving a cooperatively threaded nipple and ring assembly, a portion of the nipple being engaged between the mouth of a protruding container neck and the ring.

10. A container adapter compatible with and for removable attachment to more than one standardized form of container having a neck with at least one external container thread, the container adapter comprising:

a funnel portion including a funnel wall, the funnel wall defining a first edge;

a cylindrical portion integral with and extending from the first edge, the cylindrical portion having a wall with an inside surface and an outside surface with the wall defining a cavity extending through and communicating with the funnel portion;

more than one internal thread segment provided on the inside surface of the cylindrical portion each segment spaced circumferentially from each other segment, the more than one internal thread segment being configured for engagement with the at least one external container thread on the neck of one of the more than one standardized forms of container;

the cylindrical portion includes a funnel edge coupled to the first edge of the funnel portion and a container edge spaced apart from the funnel edge, at least one gripping portion positioned proximate to and extending generally from the container edge end of the cylindrical portion, the at least one gripping portion providing engagement between the cylindrical portion and the neck of the container when the cylindrical portion is coupled to the container neck; and at least one expansion slit of the container adapter, each slit extending from an inside surface to an outside surface of the cylindrical wall for facilitating expansion of the wall when applying the container adapter to the neck of standardized containers of a variety of dimensions.

11. The container adapter of claim 10, further comprising two generally arcuate gripping portions positioned in the cylindrical portion generally in opposition to each other.

12. The container adapter of claim 10, wherein the at least one gripping portion is generally flexible and frictionally engages the neck of the container.

13. The container adapter of claim 10, wherein the at least one internal thread segment is disposed around an inside surface of the cylindrical portion and protrudes into the cylindrical opening, the at least one internal thread segment is adapted to engage with the external container threads of the container and the at least one internal thread segment being engagable with multiple containers having different external container thread configurations or dimensions.

14. The container adapter of claim 13, wherein the internal thread segments are threadably couplable to the external container threads of the container when the funnel portion is positioned between the cylindrical portion and the container, and the internal thread segments are not threadably coupled to the external container threads of the container when the cylindrical portion is positioned between the funnel portion and the container.

15. The container adapter of claim 13, wherein the internal thread segments are threadably couplable to the external container threads of the container when the funnel portion is positioned between the cylindrical portion and the container and a mouth of the container neck extends upwardly through the cylindrical opening.

16. The container adapter of claim 14, wherein the cylindrical portion includes an external cylinder threaded portion, the external cylindrical threaded portion being configured for receiving a cooperatively threaded nipple-and-ring assembly.

17. The container adapter of claim 10, wherein the one or more expansion slits extend more than half-way between a container edge of the cylindrical portion and a funnel edge of the cylindrical portion, the funnel edge coupled to the first circular edge of the funnel portion and the container edge spaced apart from the funnel edge.

18. The container adapter of claim 10, wherein the one or more expansion slits comprise two slits positioned about 180 degrees apart on the circumference of the cylindrical portion.

19. A container adapter compatible with and for removable attachment to at least more than one standardized form of container having a neck with at least one external container thread, the container adapter comprising:

a funnel portion including a funnel wall, the funnel wall defining a first edge;

a cylindrical portion integral with and extending from the first edge, the cylindrical portion having a wall with an inside surface and an outside surface with the wall defining a cavity extending through and communicating with the funnel portion;

more than one internal thread segment provided on the inside surface of the cylindrical portion each segment spaced circumferentially from each other segment, the more than one internal thread segment being configured for engagement with the at least one external container thread on the neck of one of the more than one standardized forms of container when the funnel portion is positioned between the cylindrical portion and the container, and the internal thread segments are not threadably coupled to the external container threads of the container when the cylindrical portion is positioned between the funnel portion and the container, the internal thread segments are threadably couplable to the external container threads of the container when the funnel portion is positioned between the cylindrical portion and the container and a mouth of the container neck extends upwardly through the cylindrical opening;

the cylindrical portion includes a funnel edge coupled to the first edge of the funnel portion and a container edge spaced apart from the funnel edge, at least one gripping portion positioned proximate to and extending generally from the container edge end of the cylindrical portion, the at least one gripping portion providing engagement between the cylindrical portion and the neck of the container when the cylindrical portion is coupled to the container neck;

at least one expansion slit of the container adapter, each slit extending from an inside surface to an outside surface of the cylindrical wall for facilitating expansion of the wall when applying the container adapter to the neck of standardized containers of a variety of dimensions; and the cylindrical portion includes an external cylinder threaded portion, the external cylindrical threaded portion being configured for receiving a cooperatively threaded nipple-and-ring assembly.

* * * * *